United States Patent [19]

Chalmers et al.

[11] 4,228,629

[45] Oct. 21, 1980

[54] VERTICAL SIDING SYSTEM

[75] Inventors: Alexander A. Chalmers, Warren; J. Lynn Gailey, Newton Falls; James A. Englund; Stephen Popek, both of Warren, all of Ohio

[73] Assignee: Alcan Aluminum Corporation, Cleveland, Ohio

[21] Appl. No.: 909,937

[22] Filed: May 26, 1978

[51] Int. Cl.[3] ..... E04C 1/34

[52] U.S. Cl. ..... 52/460; 52/468; 52/471

[58] Field of Search ..... 52/460, 465, 468, 471, 52/469, 470, 461, 464

[56] References Cited

U.S. PATENT DOCUMENTS

| | | | |
|---|---|---|---|
| 2,339,865 | 1/1944 | Larmoss | 52/468 X |
| 2,578,085 | 12/1951 | Perkins | 52/464 |
| 2,803,858 | 8/1957 | Rader | 52/468 X |
| 3,545,154 | 12/1970 | Bobzin et al. | 52/460 |
| 3,594,028 | 7/1971 | Scott | 52/465 |
| 3,605,368 | 9/1971 | Lalouche | 52/471 X |
| 3,868,802 | 3/1975 | Schubach | 52/468 X |
| 4,063,393 | 12/1977 | Toti | 52/461 X |

*Primary Examiner*—James A. Leppink
*Assistant Examiner*—Carl D. Friedman
*Attorney, Agent, or Firm*—Cooper, Dunham, Clark, Griffin & Moran

[57] ABSTRACT

A vertical siding system for an exterior building wall, including vertically oriented panels mounted in flush side-by-side array on supporting structure of the wall and vertically oriented cover members covering the joints between adjacent panels and interlocked with the panels. The cover members have locking flanges along their side edges for insertion in locking grooves formed in side portions of the panels, and are resiliently deformable so that they can be snap-fitted onto the panels after the panels are mounted on the wall. The panels and cover members may be designed to cooperatively simulate the appearance of conventional board-and-batten wooden siding.

5 Claims, 7 Drawing Figures

Fig. 1.
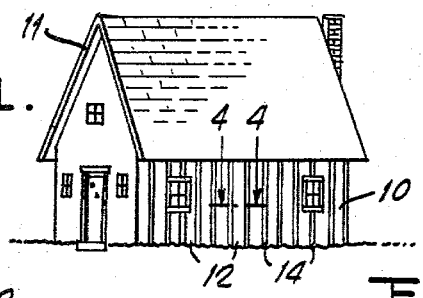
Fig. 3.
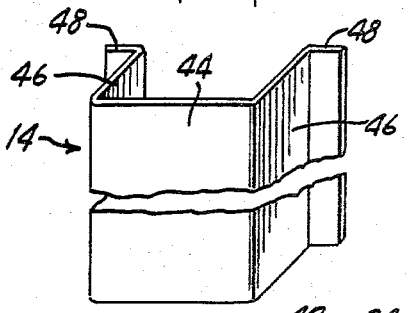
Fig. 2.
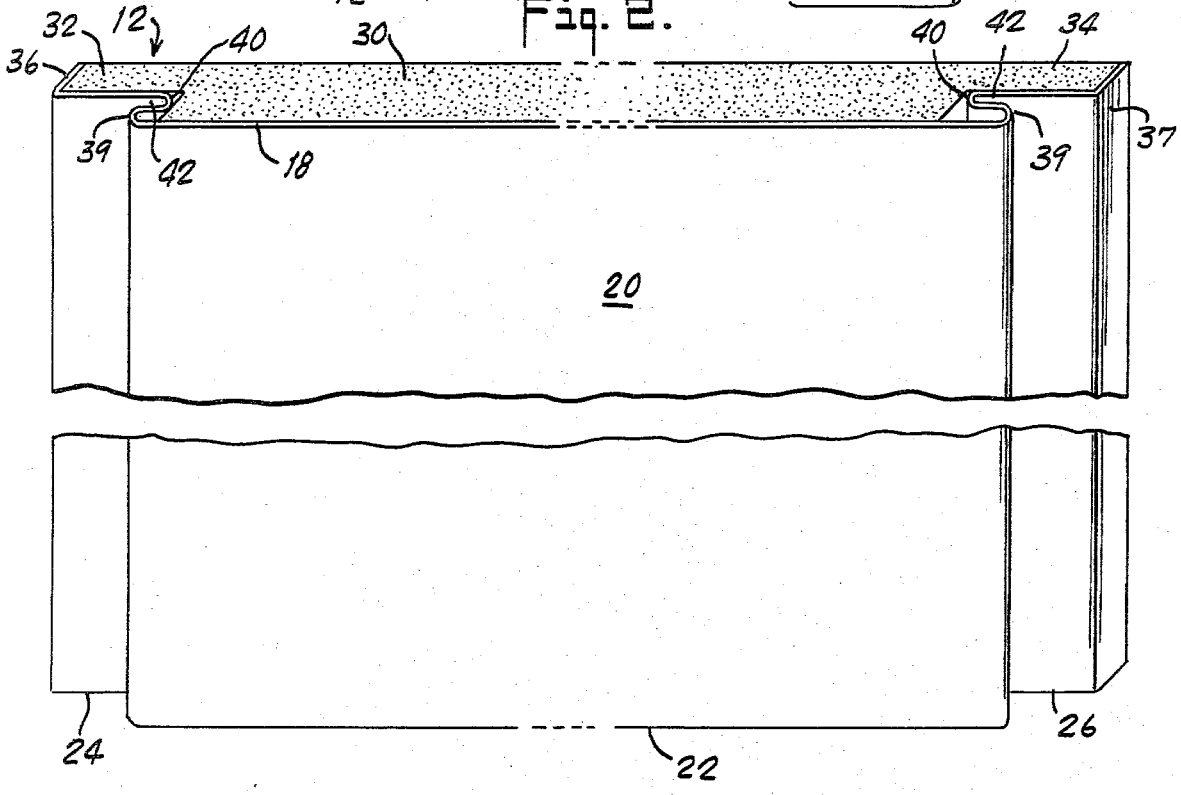
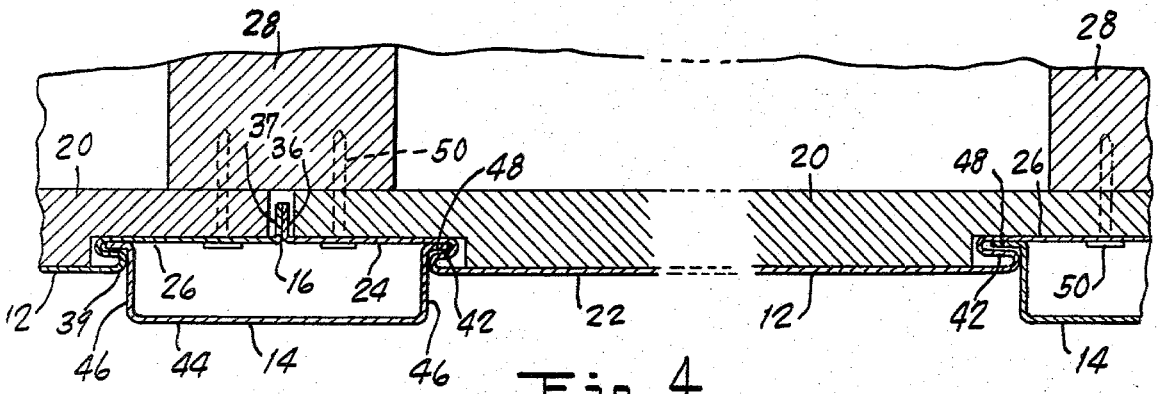
Fig. 4.

VERTICAL SIDING SYSTEM

BACKGROUND OF THE INVENTION

This invention relates to building structures having metal or like siding mounted on walls thereof, and more particularly to so-called vertical siding systems for building walls. In an important specific sense, the invention is directed to vertical siding systems, for exterior walls, designed to simulate the appearance of wooden board-and-batten siding.

As used herein, the terms "building" and "building structure" will be understood to include mobile homes as well as houses and other buildings constructed in situ.

Metal and like siding systems are widely used on exterior walls in present-day building construction, in place of conventional wooden siding. These systems afford various advantages over wood, notably including durability and freedom from maintenance; prepainted metal siding panels, for example, do not require frequent repainting as is ordinarily needed in the case of wooden shingles or clapboards. Desirably, such siding systems should be structurally simple and easy to install, yet secure against dislodgment when in place. It is also desirable in many instances that the siding system provide insulation for the building on which it is mounted, and that is be capable of serving as a complete exterior wall in itself, i.e. when attached directly to supporting wall structure such as studs.

Typically, a metal siding system comprises an array of elongated metal panels secured adjacent their edges as by nails to the supporting wall structures, and interlocked or otherwise so arranged that the nailholes and the joints between panels are shielded from penetration by atmospheric moisture. A siding system is termed "horizontal" if the long dimensions of the panels are oriented horizontally, and "vertical" if the long dimensions of the panels are oriented vertically. Generally speaking, for aesthetic reasons metal siding systems are designed to resemble traditional wooden wall surfaces; a horizontal system is employed to simulate the appearance of horizontal wooden clapboards, for example, while a vertical system is used when it is desired to simulate the appearance of vertical wood siding such as boards and battens.

It has heretofore been proposed to provide a vertical metal siding system wherein only one side edge of each panel is nailed to the supporting wall, while the other side edge of each panel overlaps and interlocks with the nailed edge of the panel immediately next to it, thereby securing the panels and covering the joints and nailboards; the overlapping edge portion of each panel is formed into a raised vertical rib projecting outwardly with respect to the major surface of the panel so as to simulate the appearance of conventional wooden board-and-batten siding. This overlapping arrangement, however, has disadvantages in that the configuration of the panels militates against provision of a continuous insulating layer by simply adhering an insulating backing to each panel, and also in that the overlapping, interlocked arrangement of panels ordinarily prevents replacement of a damaged panel unless the entire array of interlocked panels (on the wall containing the damaged panel) is removed. Alternatively, it has heretofore been proposed to resort to assemblies of multiple different and relatively complex component elements (presenting difficulties of installation) to achieve the desired protective coverage of joints and nailholes, and the desired resemblance to wooden walls, in vertical metal siding systems. In particular, it has been difficult to achieve a functionally satisfactory metal siding system that effectively simulates the appearance of board-and-batten siding, i.e. siding constituted of broad, flush vertical wood boards with the joints between boards covered by outwardly projecting narrow vertical wood battens.

SUMMARY OF THE INVENTION

The present invention broadly contemplates the provision of a two-component vertical siding system comprising a plurality of elongated siding panels mountable in parallel, vertically oriented, side-by-side array on supporting wall structure with their long edges abutting, each panel having a pair of oppositely opening locking grooves respectively extending along but spaced from the long edges of the panel; and a plurality of elongated, vertically oriented, resiliently deformable cover members for extending outwardly of and covering the joints between adjacent panels of the array, each cover member having a pair of oppositely directed longitudinal locking flanges respectively insertable in the locking grooves adjacent the abutting edges of adjacent panels for snap-fitting interengagement therewith. It will be understood that terms such as "inner" or "inwardly" and "outer" or "outwardly," as used herein, refer respectively to directions toward and away from the supporting wall structure on which the siding system is mounted.

In this system, each panel is fixedly secured to the supporting wall structure by a multiplicity of fastening elements, such as nails, driven through marginal portions of the panels between the locking grooves and the panel edges respectively adjacent thereto, so that the cover members cover the nail heads as well as the joints between panels. For use with wall structure comprising an array of spaced studs, the panels may be of such width that their opposite marginal portions may respectively be directly nailed into adjacent studs.

Further in accordance with the invention, each panel has a broad central portion extending the length of the panel, with a flat outer surface, and a pair of fastening flanges extending the length of the panel along the opposite sides of the central portion; the outer surfaces of the fastening flanges are offset inwardly with respect to the outer surface of the central portion, and the locking grooves respectively extend the length of the panel on opposite sides of the central portion, i.e. between the central portion and the fastening flanges. The fastening flanges constitute the marginal portions of the panel, through which the nails are driven to secure the panel to a wall. The locking grooves open laterally in opposite directions away from the central portion, so that when the panels are mounted, locking grooves of adjacent panels face each other across their abutting long edges. In a presently preferred embodiment, each cover member is a resiliently deformable, inwardly opening channel section comprising a central web and a pair of legs respectively having inner longitudinal edges bent laterally in opposite directions to constitute the locking flanges; these presently preferred cover members are dimensioned to project outwardly of the panels, when they are snap-fitted on the panels, so as to simulate the appearance of wood battens. Alternatively, however, recessed cover members may be provided.

Both the panels and the cover members may be formed sheet metal strips, having surfaces protectively and decoratively coated as with paint. The panels may further include insulating backer members adhered to the inner surfaces of the metal panel strips; these backer members may be substantially rigid, extending over the full width and length of the panels so as to aid in stiffening and supporting the panels, and (when the panels are installed) to be closely adjacent each other at their side edges thereby providing an effectively continuous insulating layer beneath the panels.

This two-component system is installed by simply nailing the panels side by side on studs or other wall structure and then snap-fitting the cover members into place over the panel joints. In this way there is provided a secure, permanent, insulating outer wall, having all joints and nail-holes shielded from penetration by moisture, and effectively resembling wooden boards and battens, without any need for supplemental mounting elements such as separate clips or strips. If a cover member becomes damaged, it can be removed and replaced without disturbing any of the panels; similarly, to replace a panel, only the single panel requiring replacement (and the cover members interlocked with it) need be removed.

Further features and advantages of the invention will be apparent from the detailed description hereinbelow set forth, together with the accompanying drawing.

BRIEF DESCRIPTION OF THE DRAWING

FIG. 1 is a view of a building having an exterior wall faced with a siding system embodying the present invention in a particular form;

FIG. 2 is a fragmentary perspective view of a panel of the siding system of FIG. 1;

FIG. 3 is a fragmentary perspective view of a cover member of the siding system of FIG. 1;

FIG. 4 is a fragmentary sectional view of the siding system, taken along the line 4—4 of FIG. 1;

DETAILED DESCRIPTION

Figure 5:
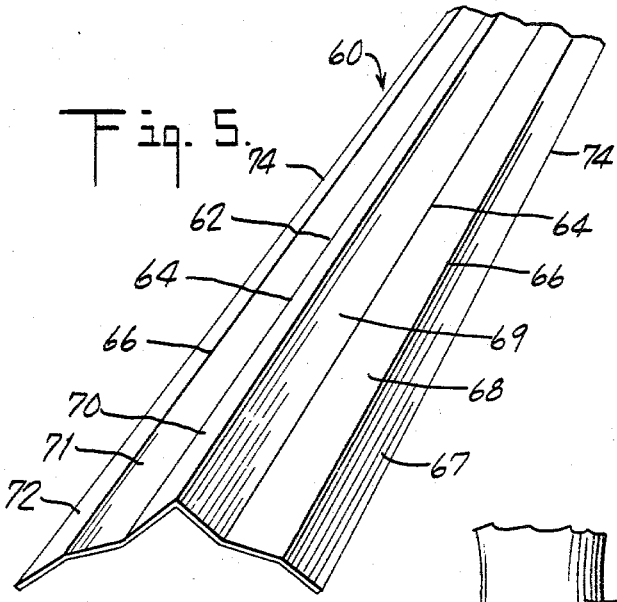
FIG. 5 is a fragmentary perspective view of an alternative form of cover member.

Referring first to FIGS. 1–4, the invention will be described as embodied in a metal siding system 10 designed to be installed on exterior walls of a house 11 (FIG. 1) or other structure and to simulate the appearance of traditional wooden board-and-batten siding. This system comprises a plurality of elongated, generally flat metal siding panels 12, mounted side by side in edge-abutting parallel array with their long dimensions oriented vertically, and a corresponding plurality of elongated vertically oriented metal cover members 14 which extend along the joints 16 (FIG. 4) between adjacent panels in externally covering relation thereto and are interlocked with the panels.

As shown in FIG. 2, each of the panels 12 comprises a formed strip 18 of sheet metal, e.g. 0.019-inch-gauge aluminum or aluminum alloy strip, to the inner surface of which is adhered a backer 20 of insulating material. The panel 12 of FIG. 2 has a board, flat central portion 22 extending the length of the panel, and a pair of narrow, flat marginal portions 24 and 26 respectively extending along opposite sides of the central portion 22 (also for the length of the panel) and offset inwardly with respect thereto so as to constitute fastening flanges through which the panel is nailed or otherwise secured to supporting wall structure such as studs 28 (FIG. 4). Since typical wall studs are 2-inch×4-inch wooden uprights spaced 16 inches apart on centers, each panel may conveniently have an overall width (greatest horizontal dimension) of 16 inches, the width of the flat central portion 22 being about 14 inches and each of the marginal portions or fastening flanges 24 and 26 being about one inch wide. The length of the panel may be conventional for vertical siding panels, e.g. 8 or 10 feet, conforming generally to the height of a one-story wall.

The backer 20, which may be a more or less rigid, solid continuous body fabricated (for example) of a foamed polymeric insulating material, has a relatively thick central portion 30 and thinner longitudinal edge portions 32 and 34 so as to conform generally to the configuration of the panel inner surface; thus the central portion 30 has a flat outer surface, while side portions 32 and 34 have flat outer surfaces offset inwardly with respect to the surface of the central portion, the inner surface of the backer being planar across its entire width. When the panel is installed (FIG. 4), the inner surface of the backer lies flat against the studs 28, and substantially fills the space between the outer surfaces of the studs and the inner surface of the metal panel 12, thereby helping to support and stiffen the panel as well as serving an insulating friction. The longitudinal edges 36 and 37 of the metal panel 12 are bent inwardly at right angles to the fastening flanges 24 and 26 to cover the side edges of the backer.

As a particular feature of the invention, at each side of the central portion 22 the metal panel 12 has, in succession, a first 180° inward and reverse bend 39 and a second 180° inward and reverse bend 40 defining a locking groove or channel 42 which opens laterally toward the adjacent side edge of the panel and extends for the full length of the panel. Thus each panel has two identical locking grooves 42, respectively extending along the opposite sides of the panel central portion 22, and opening in opposite directions, viz. away from the longitudinal center line of the panel, the locking grooves being spaced from the panel side edges 36 and 37 by the width of the fastening flanges 24 and 26. When the panels are mounted on a supporting wall structure in side-by-side relation with the edge 37 of one panel abutting the edges 36 of the next adjacent panel, such that the fastening flange 26 of the first-mentioned panel is flush with the fastening flange 24 of the second-mentioned panel, the locking grooves 42 respectively formed on the abutting sides of the two panels face each other (i.e. open toward each other) across the joint 16 between the panels and are spaced from each other by the combined width of the abutting fastening flanges 26 and 24 of the respective panels.

Further in accordance with the invention, as shown in FIG. 3, in the preferred embodiment of the siding system each of the cover members 14 is a resiliently deformable, elongated, inwardly opening metal channel section (e.g. formed from 0.019-inch gauge aluminum or aluminum alloy strip) having a central web 44 and two inwardly projecting legs 46, wherein the inner edge of each leg is bent 90° away from the longitudinal center line of the cover member to constitute a laterally projecting longitudinal locking flange 48 extending for the full length of the cover member. Each cover member accordingly has two such locking flanges 48, respectively extending along the inner extremities of the two sides or legs of the cover member, and projecting away from each other. These locking flanges are each dimensioned to be received in a locking groove 42 of a panel 12. The width of the cover member 14, exclusive of the locking flanges, is equal to the combined width of the two abutting fastening flanges 26 and 24 of two adjacent mounted panels (i.e. equal to the distance between the facing locking grooves of the two panels); for example, if the width of each panel fastening flange is one inch, the width of the cover member (exclusive of the locking flange) is two inches. The length of each cover member is typically equal to the length of the panels with which it is used. The depth of each cover member (i.e. the dimension of the legs 46 between the locking flanges 48 and the web 44), in this embodiment, is sufficient so that, when interlocked with panels 12 as hereinafter described, the cover member projects outwardly substantially beyond the panel central portions 22 to simulate the appearance of a conventional wooden batten.

The panels 12 and cover members 14 may be produced from initially flat aluminum or aluminum alloy strip by roll-forming, and cut to the desired lengths; the provision of appropriate roll-forming arrangements for this purpose will be readily apparent to those skilled in the art, from the foregoing description of panel and cover member configuration, and accordingly need not be described in detail. The backers 20, pre-cut to shape, are adhered to the panels after the panels are formed. Preferably, the external surfaces of the panels and cover members are painted or otherwise protectively coated before they are installed; to heighten the resemblance of the siding system to wooden board-and-batten siding, the paint coating may be shaded or grain-patterned to simulate weathered wood, and/or the panels may be embossed with a rough or weathered-grain pattern.

In the installation of the system, the panels 12 are so positioned that their fastening flanges 24 and 26 overlie the studs 28 of the supporting wall structure, i.e. so that the joints 16 between adjacent panels substantially coincide with the longitudinal center lines of the studs; with panels of the width described above, each positioned to extend from center line to center line of adjacent studs, the two fastening flanges of each panel respectively overlie two studs. As each panel is positioned, it is fixedly secured to the supporting structure by appropriate fastening elements, e.g. nails 50, driven through the fastening flanges along each side of the panel into the subjacent studs at spaced locations along the panel length. The next panel is then positioned in edge-abutting relation to the mounted panel, and fastened to the supporting wall structure in its turn, until the wall or walls to be clad with siding are completely covered with the panels. It will be understood that when the panels are mounted as described, there is a gap or recess between the central portions 22 of each pair of adjacent panels, the fastening flanges 26 and 24 and the joint 16 between the panels being located in this recess.

Thereafter, the cover members 14 are mounted on the wall to fill the recesses between the central portions of adjacent panels and thereby to cover the joints between the panels. Since the cover members are resiliently deformable, each cover member may simply be laterally compressed (e.g. manually) by pressing its legs 46 together until the locking flanges 48 clear the facing bends 39 of two adjacent mounted panels, and inserted between these bends, i.e. into the recess defined between the central portions of the panels; upon release of the resilient cover member from lateral compression, its locking flanges 48 respectively snap into the facing locking grooves 42 of the two panels and the cover member legs 46 bear against the facing bends 39 of the panels, holding the cover member securely in place, interlocked with the panels. This snap-fitting interengagement of the cover members with the panels facilitates their installation, and also enables removal of the cover members from the panels if necessary for repair of replacement of cover members and/or panels. When thus installed, the cover members cover the joints 16 between adjacent panels, the fastening flanges 26, 24 of the panels, and the heads of the nails 50, as desired for aesthetic and protective reasons; at the same time, they cooperate with the exposed outer surfaces of the panel central portions 22 to simulate the appearance of wooden board-and-batten siding.

The two-component siding system thereby provided affords a fully protective and insulating outer wall, with the cover members shielding the joints between panels and the nail holes against penetration by atmospheric moisture. Thus, while it may be mounted over conventional sheathing, as shown in FIG. 4 it may advantageously be installed directly on the studs of a wall. As will be appreciated, in common with other types of metal siding installations, precoated, formed, sheet metal trim members of appropriate configurations may be mounted at the tops, bottoms and corners of walls and around windows and doors to receive edges of the siding panels. Also, while the siding system has been shown and described as installed on a house wall, it may be used on other types of structures as well, e.g. on mobile homes.

Although the batten-shaped cover members 14 of the system of FIGS. 1–4 are at present preferred, not only for their resemblance to conventional wooden battens but also because of the ease with which they can be removed when necessary, it is desirable in some instances (e.g. for aesthetic reasons) to provide a vertical siding wall having recessed cover members rather than protruding battens. An alternative embodiment of the system of the invention, having such recessed cover members 60 interlocked with panels 12 (identical to the panels 12 of FIGS. 1—4), is illustrated in FIGS. 5–17.

As best seen in FIG. 5, each member 60 is a resiliently deformable strip of sheet material, e.g. sheet metal such as aluminum (suitably prepainted), having formed therein a central longitudinal bend 62, a first pair of side longitudinal bends 64, and a second pair of longitudinal bends 66, extending parallel to each other for the full length of the strip and substantially equidistantly spaced so as to sub-divide the strip into six narrow, parallel longitudinal flat portions 67, 68, 69, 70, 71 and 72 of substantially equal width. The bend 62, which coincides with the longitudinal centerline of the strip or member 60, opens inwardly at an obtuse angle (e.g. 105° ). On each side of this central bend is disposed one of the bends 64, both of which open outwardly, and between each bend 64 and the adjacent longitudinal margin 74 of the member 60 is disposed one of the bends 66, both of which open inwardly; the angles of the bends 64 and 66 are also, as shown, all obtuse (e.g. 155° ). Thus, the surfaces of the aforementioned portions 67 and 72, which respectively extend along the opposite longitudinal margins 74 of the strip or member 60, respectively lie in planes diverging at an angle of 105° (i.e. when the member is in the condition shown in FIGS. 5 and 6, prior to installation); these marginal portions 67 and 72 constitute the locking flanges of the member 60. For use with panels 12 having the dimensions given above by way of example, wherein the distance between the facing locking grooves 42 of two adjacent abutting panels is two inches, the width of the member 60 (measured between the opposite margins 74, when the member is in the pre-installation condition shown in FIGS. 5 and 6) is two inches, and the altitude of the apex of the central bend 62 (measured from the plane containing margins 74, again with the member in the condition shown in FIGS. 5 and 6) may be $\frac{5}{8}$ inch.

Figure 6:
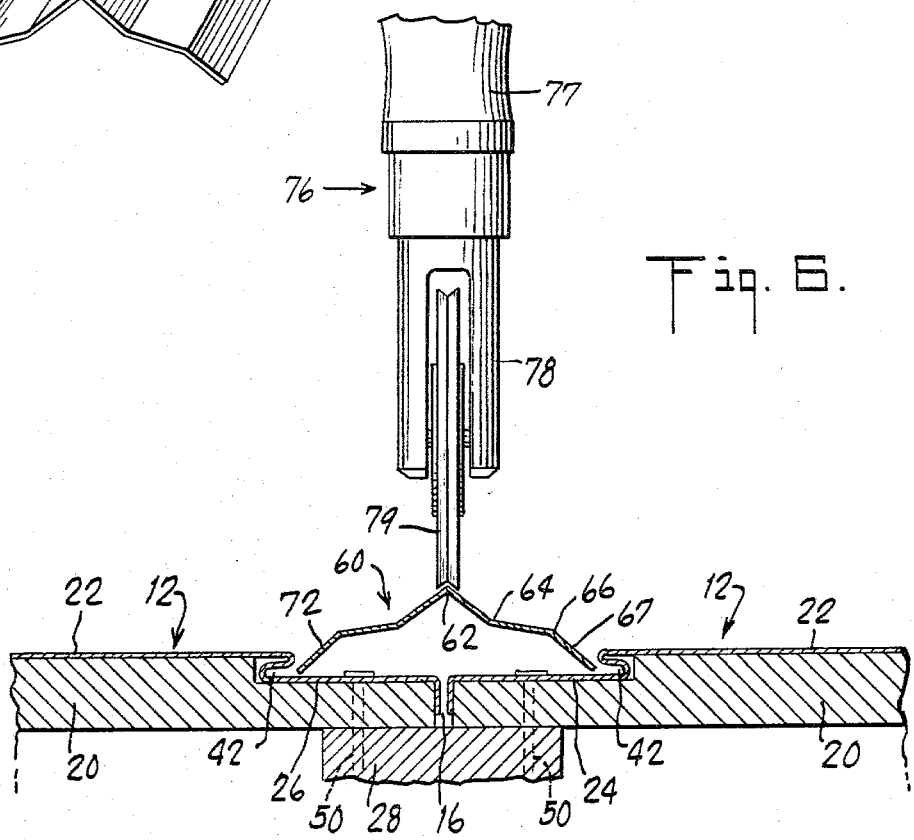
FIG. 6 is a fragmentary sectional view of a siding system illustrating installation of the cover member of FIG. 5.
Figure 7:
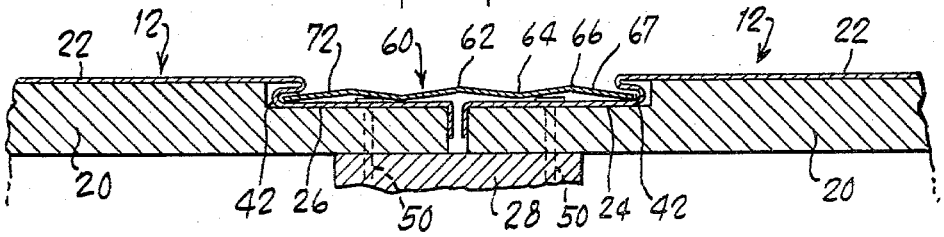
FIG. 7 is a view similar to FIG. 6, showing the FIG. 5 cover member in place after installation.

For installation of the system of FIGS. 5–7, the panels 12 are mounted on supporting wall structure in the same manner as already described for the system of FIGS. 1–4. A cover member 60, with its long dimension oriented vertically and its locking flanges 67 and 72 diverging toward the panels, is inserted in the space between the locking grooves 42 of two adjacent abutting panels 12 (FIG. 6) and snap-fitted into place by means of a hand roller 76 comprising a handle 77 and a split shank 78 rotatably supporting a grooved wheel 79 which runs along the central bend 62 of the member 60; the roller 76 transmits inwardly directed manual pressure to the member 60, flattening it and forcing its locking flanges 67 and 72 into the facing locking grooves 42 of the two panels 12, thereby to interlock the cover member with the panels as shown in FIG. 7. This procedure is then repeated until all the cover members have been installed. As FIG. 7 illustrates, when thus installed the flattened cover members 60 are recessed inwardly with respect to the panel central portions 22, but (like the cover members of FIGS. 1–4), they cover the joints 16 between panels and the nail holes of the panel fastening flanges 24 and 26.

As will be appreciated from the foregoing description, in the described recessed cover member 60 (prior to installation, i.e. in the FIG. 5 condition) inwardly opening bends alternate with outwardly opening bends across the width of the member; and both the inwardly opening bends 66 and the outwardly opening bends 64 on the sides open at larger obtuse angles than the central bend 62. This combination of features, in conjunction with the substantial equality of width of all the flat portions 67–72, imparts to the member an initial (pre-installation) configuration that facilitates the snap-fitting insertion of the locking flanges 67 and 72 into the locking grooves 42 by the described flattening of member 60, which flattening operation increases the effective width (minimum distance between opposite longitudinal margins 74) of the member so that the opposed locking flanges simultaneously extend into the respective locking grooves, thereby securing the member in place in the panel assembly.

It is to be understood that the invention is not limited to the features and embodiments hereinabove specifically set forth but may be carried out in other ways without departure from its spirit.

We claim:

1. A vertical siding system mounted on a supporting wall, said system comprising:

(a) a plurality of vertically elongated siding panels having longitudinal edges, disposed in parallel, edge-abutting, side-by-side array outwardly of said wall;

(b) for each of said panels, a plurality of fastening elements for securing the panel to the wall; and (c) a plurality of vertically elongated, resiliently deformable cover members respectively disposed outwardly of the abutting edges of adjacent panels of said array in covering relation to said abutting edges;

(d) each of said panels comprising a unitary, formed sheet metal strip and a substantially rigid insulating body disposed inwardly thereof, both the strip and the body extending over the full width of the panel, each said panel having (i) a broad central portion with a substantially flat outer surface, extending the length of the panel, (ii) first and second fastening flanges respectively extending the length of the panel along said longitudinal edges on opposite sides of said central portion, said fastening flanges having outer surfaces offset inwardly with respect to the outer surface of said central portion, said fastening elements for each said panel extending through the fastening flanges thereof into the wall, and (iii) portions defining first and second locking grooves formed in the sheet metal strip and respectively extending the length of the panel on opposite sides of said central portion between and central portion and said fastening flanges, said locking grooves respectively opening laterally of said panel in opposite directions away from said central portion such that locking grooves of adjacent panels face each other across the abutting edges of the panels;

(e) each of said cover members comprising a formed sheet metal strip having a pair of longitudinal locking flanges, respectively projecting laterally of the cover member in opposite directions and positioned and dimensioned such that they are re-respectively received in the facing locking grooves of adjacent panels mounted on the wall, thereby to retain the cover member in covering relation to the abutting edges and adjacent fastening flanges of the adjacent panels;

(f) each of said cover members being resiliently deformable and being shaped and dimensioned for snap-fitting interengagement of the cover member with facing groove-defining portions of adjacent panels such that the cover member is capable of being deformed for lateral insertion of its locking flanges into the facing grooves of the adjacent panels and is held under compression between the last-mentioned groove-defining portions;

(g) said panel strip having longitudinal edges bent inwardly at right angles to said fastening flanges to cover the longitudinal edges of said insulating body.

2. A vertical siding system mounted on a supporting wall, said system comprising:

(a) a plurality of vertically elongated siding panels having longitudinal edges, disposed in parallel, edge-abutting, side-by-side array outwardly of said wall;

(b) for each of said panels, a plurality of fastening elements for securing the panel to the wall; and (c) a plurality of vertically elongated, resiliently deformable cover members respectively disposed outwardly of the abutting edges of adjacent panels of said array in covering relation to said abutting edges;

(d) each of said panels comprising a unitary, formed sheet metal strip and a substantially rigid insulating body disposed inwardly thereof, both the strip and the body extending over the full width of the panel, each said panel having (i) a broad central portion with a substantially flat outer surface, extending the length of the panel, (ii) first and second fastening flanges respectively extending the length of the panel along said longitudinal edges on opposite sides of said central portion, said fastening flanges having outer surfaces offset inwardly with respect to the outer surface of said central portion, said fastening elements for each said panel extending through the fastening flanges thereof into the wall, and (iii) portions defining first and second locking grooves formed in the sheet metal strip and respectively extending the length of the panel on opposite sides of said central portion between said central portion and said fastening flanges, said locking grooves respectively opening laterally of said panel in opposite directions away from said central portion such that locking grooves of adjacent panels face each other across the abutting edges of the panels;

(e) each of said cover members comprising a formed sheet metal strip having a pair of longitudinal locking flanges, respectively projecting laterally of the cover member in opposite directions and positioned and dimensionsed such that they are respectively received in the facing locking grooves of adjacent panels mounted on the wall, thereby to retain the cover member in covering relation to the abutting edges and adjacent fastening flanges of the adjacent panels;

(f) each of said cover members being resiliently deformable and being shaped and dimensioned for snap-fitting interengagement of the cover member with facing groove-defining portions of adjacent panels such that the cover member is capable of being deformed for lateral insertion of its locking flanges into the facing grooves of the adjacent panels and is held under compression between the last-mentioned groove-defining portions;

(g) each of said cover members comprising a resiliently deformable, inwardly opening channel section having a central web and a pair of legs, said legs having inner longitudinal edges respectively bent laterally in opposite directions to constitute said locking flanges, and (h) the legs of each of said cover members being dimensioned to project substantially outwardly of said panels when interlocked therewith for cooperating with said panels to simulate the appearance of wooden board-and-batten siding.

3. A system as defined in claim 2, wherein said panel strip has formed therein, along each side of said panel central portion, a first 180° inward and reverse bend and a second 180° inward and reverse bend defining one of said locking grooves.

4. A vertical siding system mounted on a supporting wall, said system comprising:

(a) a plurality of vertically elongated siding panels having longitudinal edges, disposed in parallel, edge-abutting, side-by-side array outwardly of said wall;

(b) for each of said panels, a plurality of fastening elements for securing the panel to the wall; and (c) a plurality of vertically elongated, resiliently deformable cover members respectively disposed outwardly of the abutting edges of adjacent panels of said array in covering relation to said abutting edges;

(d) each of said panels comprising a unitary, formed sheet metal strip and a substantially rigid insulating body disposed inwardly thereof, both the strip and the body extending over the full width of the panel, each said panel having (i) a broad central portion with a substantially flat outer surface, extending the length of the panel, (ii) first and second fastening flanges respectively extending the length of the panel along said longitudinal edges on opposite sides of said central portion, said fastening flanges having outer surfaces offset inwardly with respect to the outer surface of said central portion, said fastening elements for each said panel extending through the fastening flanges thereof into the wall, and (iii) portions defined first and second locking grooves formed in the sheet metal strip and respectively extending the length of the panel on opposite sides of said central portion between said central portion and said fastening flanges, said locking grooves respectively opening laterally of said panel in opposite directions away from said central portion such that locking grooves of adjacent panels face each other across the abutting edges of the panels;

(e) each of said cover members comprising a formed sheet metal strip having a pair of longitudinal locking flanges, respectively projecting laterally of the cover member in opposite directions and positioned and dimensionsed such that they are respectively received in the facing locking grooves of adjacent panels mounted on the wall, thereby to retain the cover member in covering relation to the abutting edges and adjacent fastening flanges of the adjacent panels;

(f) each of said cover members being resiliently deformable and being shaped and dimensioned for snap-fitting interenegagement of the cover member with facing groove-defining portions of adjacent panels such that the cover member is capable of being deformed for lateral insertion of its locking flanges into the facing grooves of the adjacent panels and is held under compression between the last-mentioned groove-defining portions;

(g) each of said cover members having plural parallel longitudinal bends formed therein, each said cover member undergoing bend-flattening deformation during lateral insertion of its locking flanges into the facing locking grooves of adjacent panels as aforesaid.

5. A system as defined in claim 4, wherein said cover member has five longitudinal bends substantially equidistantly spaced across its width, the spacing between each longitudinal margin of said cover member and the bend nearest thereto being substantially equal to the spacing between adjacent bends, said bends including an inwardly opening central bend coincident with the longitudinal centerline of said cover member, two outwardly opening bends respectively disposed on opposite sides of said central bend, and two inwardly opening bends respectively disposed between said last-mentioned bends and the opposite longitudinal margins of said cover member, all of said bends opening at obtuse angles, the angle at which said central bend opens being smaller than the angles at which all the others of said bends open.

* * * * *

UNITED STATES PATENT AND TRADEMARK OFFICE

CERTIFICATE OF CORRECTION

PATENT NO. : 4,228,629

DATED : October 21, 1980

INVENTOR(S) : Alexander A. Chalmers et al.

It is certified that error appears in the above-identified patent and that said Letters Patent are hereby corrected as shown below:

Col. 4, line 28, "friction" should read --function-- .

Col. 6, line 43, "5 - 17" should read --5 - 7-- .

Col. 8, line 22, "and central" should read --said central-- .

Signed and Sealed this

Ninth Day of November 1982

[SEAL]

*Attest:*

GERALD J. MOSSINGHOFF

*Attesting Officer* *Commissioner of Patents and Trademarks*